United States Patent [19]

Moro

[11] Patent Number: 4,666,158

[45] Date of Patent: May 19, 1987

[54] ADJUSTABLE BOWLING RELEASE POSITIONER

[76] Inventor: Joseph Moro, 214 Fayette St., Ithaca, N.Y. 14850

[21] Appl. No.: 790,373

[22] Filed: Oct. 23, 1985

[51] Int. Cl.[4] ..... A63B 69/00

[52] U.S. Cl. ..... 273/54 B; 128/88

[58] Field of Search ..... 273/54 B, 189 A; 2/161 A; 128/88

[56] References Cited

U.S. PATENT DOCUMENTS

| | | | |
|---|---|---|---|
| 186,700 | 1/1877 | Adams | 128/88 |
| 504,218 | 8/1893 | Hoppe | 128/88 |
| 1,418,486 | 6/1922 | Smith | 128/88 |
| 3,606,342 | 9/1971 | Albertson | 273/54 B X |
| 3,829,090 | 8/1974 | Ensinger | 2/161 A X |
| 4,176,840 | 12/1979 | Lanning | 273/189 A X |
| 4,332,382 | 6/1982 | Smith | 2/161 A X |

OTHER PUBLICATIONS

Wrist Master II—Advertisement.

The Cobra—Advertisement

Patton Enterprises—Advertisement.

Robby's—Advertisement.

Morevs Advertisement.

Accuwrist—Advertisement.

Bowling Splint—Advertisement.

Skor—Mor—Advertisement.

*Primary Examiner*—Anton O. Oechsle

*Attorney, Agent, or Firm*—Bruns and Wall

[57] ABSTRACT

A bowling release positioner that includes a hand unit and an arm unit that are joined by a connecting member. Adjusting mechanisms are provided so that the two units can be angularly positioned in two separate planes in respect to each other. The wrist unit further includes a pair of hinged jaw members that encompass a substantial part of the bowler's arm and a band for closing the jaw members about the arm with sufficient force to prevent the bowling release positioner from becoming misaligned during use.

17 Claims, 10 Drawing Figures

ADJUSTABLE BOWLING RELEASE POSITIONER

BACKGROUND OF THE INVENTION

This invention relates to a release positioning device that is worn on the arm of a bowler and, in particular, to a device that is capable of positioning the hand of a bowler in more than one plane.

In the sport of bowling, there are a number of factors that contribute to scoring well. One of these involves a good, firm, hand position during delivery and particularly at the time of release. Gloves have been developed to provide the bowler with some added wrist support. For the most part, these gloves are made of leather or other pliable materials that are tightly wrapped about the hand and wrist of the bowler. The glove attempts to align and hold the hand in one position in regard to the wrist without regard to the shot involved or the condition of the bowling lane. The bowler, being unable to effectively change his hand position, cannot adjust to the changing lane conditions which can adversely effect accuracy and lead to lower rather than higher scores.

SUMMARY OF THE INVENTION

It is therefore an object of the present invention to improve the scoring capability of a bowler.

It is a further object of the present invention to provide a bowling release positioner for supporting the wrist of a bowler that can be adjusted in at least one plane and preferably in two planes.

A still further object of the present invention is to provide a release positioner that can be comfortably secured upon the arm of a bowler and which wrist angle can be further adjusted without loosening or removing the device from the arm.

Another object of the present invention is to provide a release positioner for a bowler that can be adjusted to a large number of different positions to better control the action of the ball in response to different bowling conditions.

These and other objects of the present invention are attained by means of a release positioner for use by a bowler that includes a hand engaging unit and an arm engaging unit that are joined by a connecting member that passes over the wrist of the bowler. The units are each independently attached to the connecting member by pivots that permit the units to be angularly positioned in two separate planes. The arm unit is adjustable in a primary plane that is generally perpendicular to the plane described by the back of the bowler's hand and the hand unit is adjustable in a secondary plane that is perpendicular to the primary plane so that any number of different hand positions can be selected.

BRIEF DESCRIPTION OF THE DRAWINGS

For a better understanding of the objects of the present invention, reference is had to the following detailed description of the invention which is to be read in conjunction with the following drawings, wherein.

DESCRIPTION OF THE INVENTION

Referring initially to FIGS. 1–7, there is illustrated a bowling release positioner (hereinafter "positioner"), generally referenced 10, that embodies the teachings of the present invention. The positioner generally includes a hand unit 11 and an arm unit 12 that are joined in assembly by means of a connector 13 that passes over the back of the bowler's wrist as shown in FIGS. 3–7. The connector is pivotally coupled to both the hand and arm units so that one or both can be positioned independently in separate planes. As will be explained in greater detail below, the positioner allows the hand to be positioned in a primary plane that is generally perpendicular to the plane described by the back of the bowler's hand which might be considered an up-down plane. The positioner further permits the hand to be positioned independently in a secondary plane that is perpendicular to the primary plane which correspondingly might be considered a left-right plane. The units can be releasably locked in a selected position to firmly support the hand during delivery and release of the ball.

Figure 3:
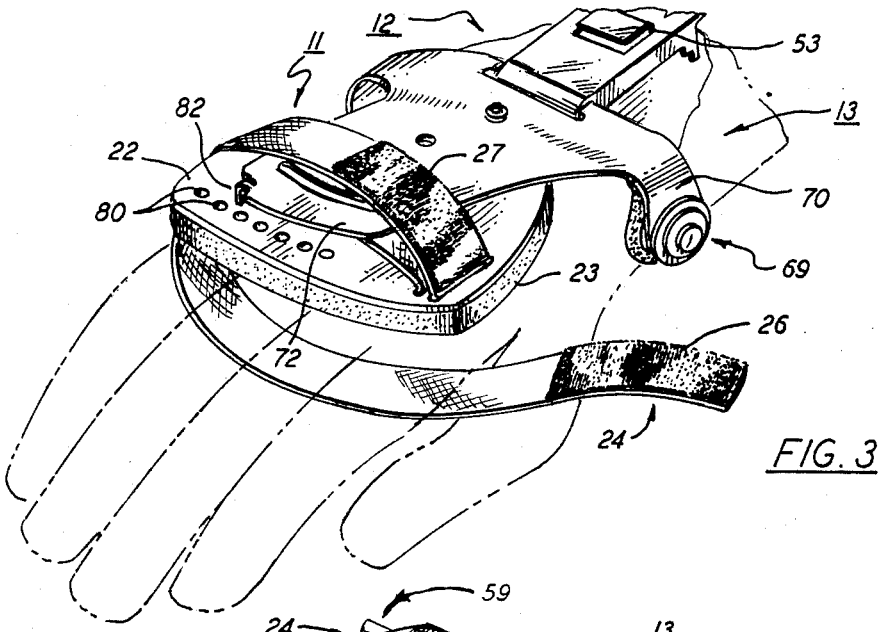
FIGS. 3–5 are views in perspective showing the glove in various positions secured to the arm of the wearer.
Figure 4:
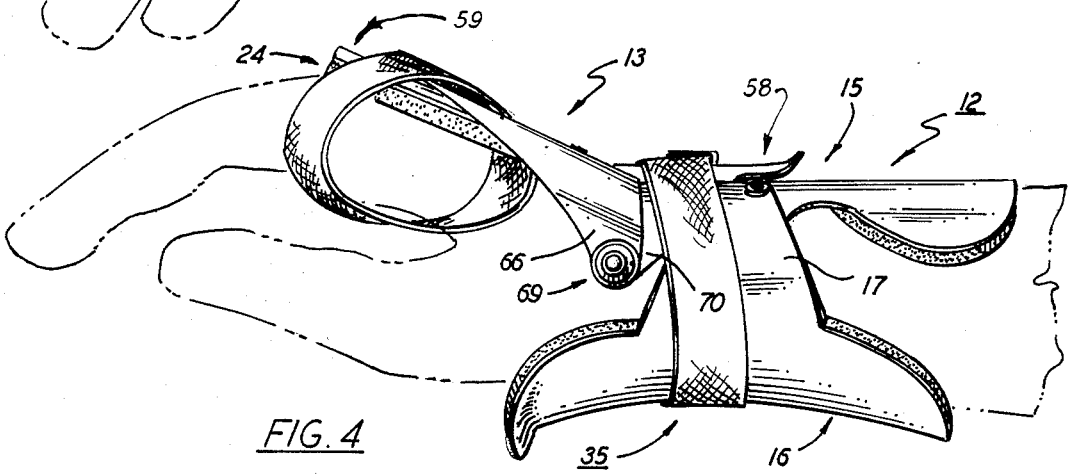
Figure 5:
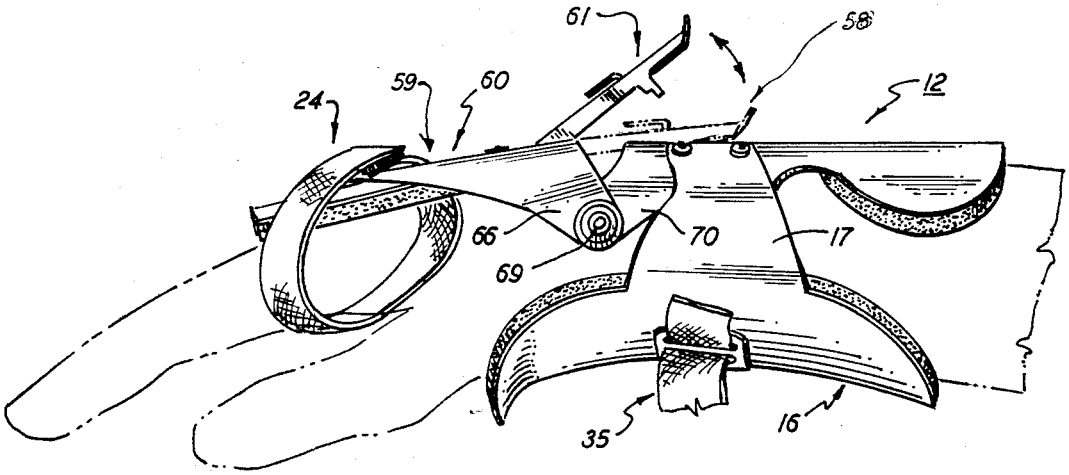

The hand unit consists of a relatively rigid back plate 22 that is contoured to fit snugly over the back of the hand up to the knuckles while still providing sufficient freedom to the fingers to allow the ball to be firmly gripped. The inside surface of the plate which faces the hand is lined with a soft pad of rubber-like material that protects the covered hand area. A closed cell urethane is used to form the pad and is secured to the back of the plate by any suitable adhesive. A strap 24 is secured at one end in the plate and is furnished with sufficient length so that it can be wrapped about the bowler's hand. As illustrated in FIG. 3, the strap is passed between the thumb and the forefinger of the hand and is then brought over the lower end of hand section 11. A Velcro fastener comprising a hook pad 26 and a loop pad 27 is attached to the strap. The pads are situated so that the strap can be selectively tightened about the hand to securely hold the hand unit in place as shown. The strap is tightened to a point where the pad is compressed into conforming contact against the hand with sufficient pressure to prevent the plate from moving.

The arm unit includes an upper jaw member 15 and a lower jaw member 16 that are hinged together to form a clam shell housing that can be passed over the bowler's arm adjacent the wrist area. The upper jaw member includes a thin but rigid metal shell 31 that is lined with a pair of soft closed cell urethane pads 32 and 33 which when the jaws are closed bear against the bowler's arm. The lower jaw member is formed of polyethelene plastic shell 29 that is fully lined by a urethane pad 30 similar to those previously described above. Here again, the pad provides a soft resilient contact surface between the more rigid shell and the arm to protect the bowler against discomfort and possible injury. The two jaw members extend laterally along the arm so that they will substantially extend between one-third and one-half of the arm length as measured between the wrist and elbow. The two members have an arcuate cross-sectional form to conform to the shape of the arm and thus provide for maximum contact between the member and the arm.

The plastic shell of the lower jaw member is turned upwardly along one edge thereof to create a hinge 17. The outer edge of the hinge is brought over the upper jaw member as shown and attached to the metal shell 31 by a pair of rivets 20 and 21. The hinge, which is sometimes referred to as a living hinge, has sufficient memory so that it can be opened and closed innumerable times without exceeding the material's modulus of elasticity.

Figure 8:
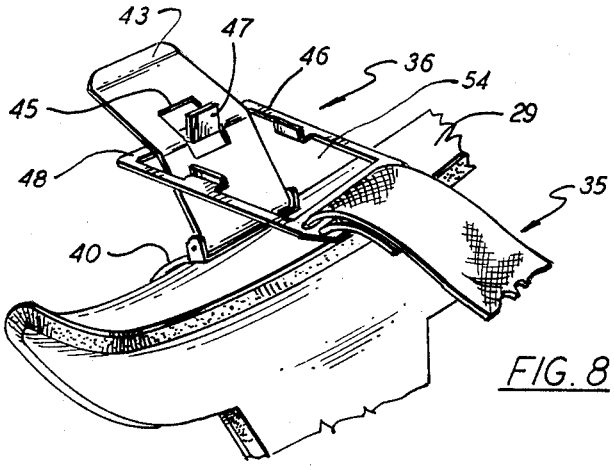
FIG. 8 is a perspective view showing the wrist strap latching mechanism in a semi-open position.
Figure 9:
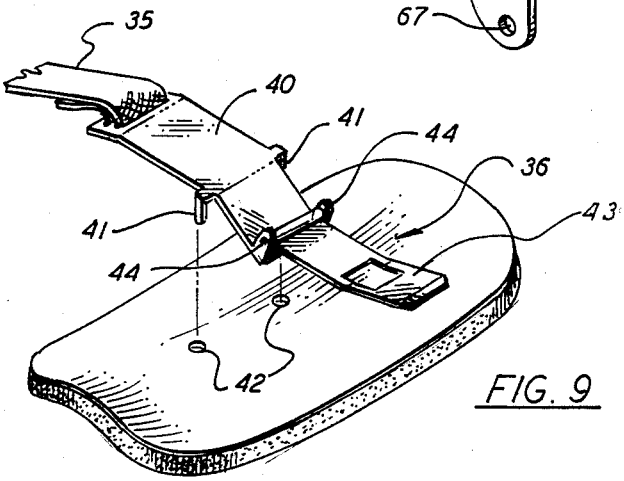
FIG. 9 is a perspective view of the wrist strap latch illustrating the latch in an open position.

A relatively wide flexible band, generally depicted at 35, is anchored at one end by any suitable means in the base plate 40 of a latch mechanism 36. The opposite end of the band is equipped with a buckle 46 that is adapted to engage the locking arm 43 of the latch mechanism as shown in FIGS. 8 and 9. The base plate is joined to the shell 29 of the lower jaw member by means of a pair of tabs 41—41 that are received in holes 42—42 formed in the shell. In assembly, the tabs are passed through the holes in the shell and bent back to draw the baseplate tightly against the outer surface of the shell. The locking arm of the latch mechanism is mounted in an overcenter condition between a pair of upraised arms 44—44. The arm is arranged to pass through the buckle hole 53 and contains a slot 45 that mates with a flange 47 carried on the front rail 48 of the buckle frame. To close the latch, the flange 47 is placed in the hole 45 as shown in FIG. 8 and the arm is rotated downwardly against the baseplate. The arm, because it is mounted in an overcenter condition, will automatically lock against the plate any time the band exerts a slight tension on the latch.

Figure 7:
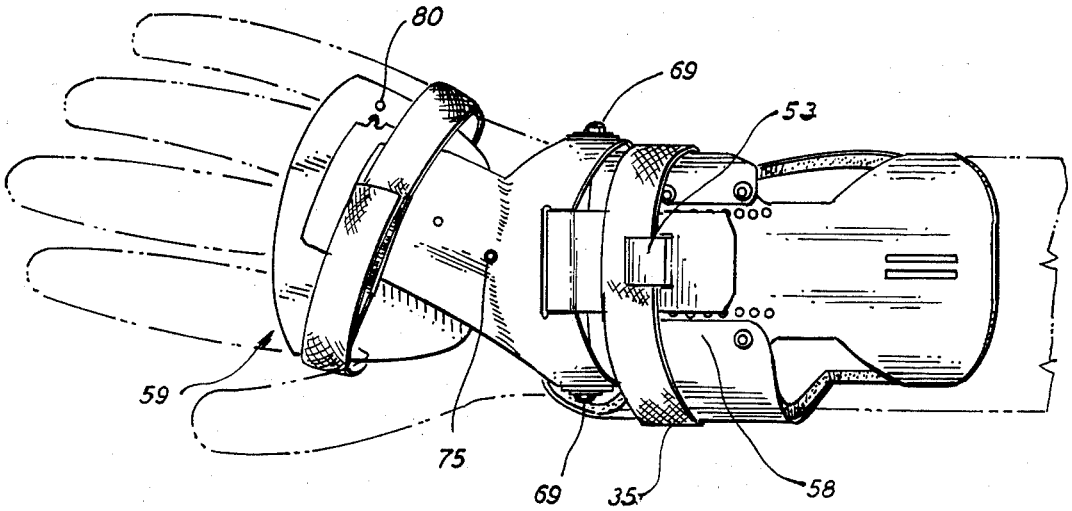

The active length of the band can be adjusted by sliding the band through an adjusting loop 49 formed in the rear rail 56 of the buckle frame. In practice, the bowler's arm is passed into the clam shell formed by the two jaw members and the band is then wrapped about the members as illustrated in FIG. 7. Closing the latching mechanism with the buckle engaged places tension on the band which moves the jaws together against the arm. By shortening or lengthening the active length of the band, the holding force exerted by the jaws against the arm can be set at a desired level. As illustrated, the band is arranged to pass over the back of the connector and is slidably received within a raised, open-sided loop 53 carried on the back surface thereof. The loop helps position the band and keeps it from sliding laterally after the jaws are closed.

As previously noted, the jaw members are both equipped with arm contacting pads. The pads are arranged to distribute the holding pressure of the jaws uniformly over a relatively wide area so that higher than normal holding forces can be tolerated without discomfort or damage to the wearer's arm. Accordingly, the positioner can be securely locked to the arm with sufficient pressure to prevent the device from moving during delivery and release.

Figure 10:
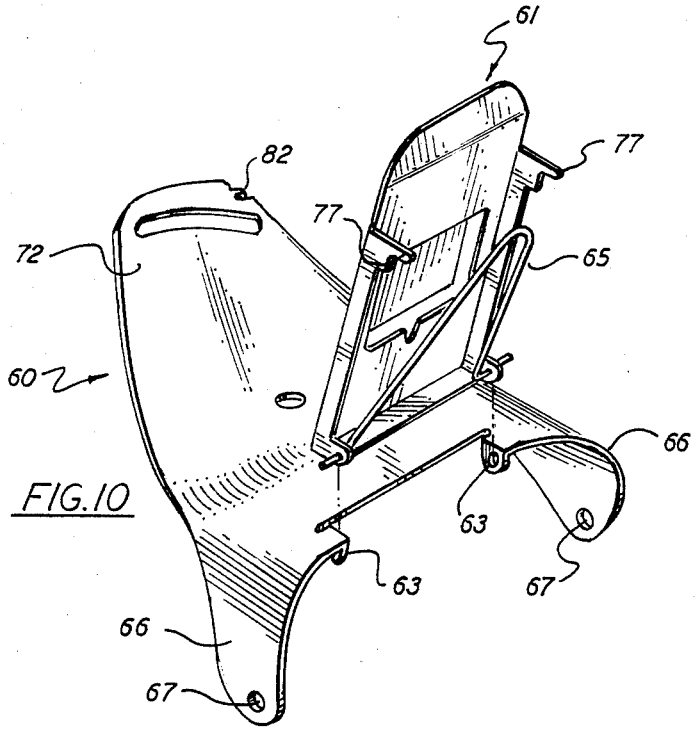
FIG. 10 is a perspective view of the connecting member used to join the hand unit of the glove to the wrist unit.

With further reference to FIG. 10, the connector joining the arm and hand units includes a frame 60 and a finger actuated locking member 61 that are fabricated from sheet metal. The locking member is a lever arm that is rotatably mounted in a coutout 62 formed in the main frame between two downwardly disposed tabs 63—63. A spring loaded pivot pin 65 is used to support the locking member between the tabs. A pair of disposed arms 66—66 are located at the back of the main frame and contain axially aligned holes 67—67 for receiving the pivot pin in assembly.

As illustrated in FIGS. 1–5, the main frame of the connector is pivotally secured to the shell of the upper jaw member by two rotor units 69—69. The units are mounted upon shell arms 70—70 and in assembly pass through the receiving holes 67—67 formed in the arms 66—66 of the connector main frame whereby the entire arm unit can be angularly positioned in regard to the connector in a first primary plane that is generally perpendicular to the plane described by the back of the bowler's hand. Through use of this arrangement, the hand can be moved in an up-down direction.

Figure 6:
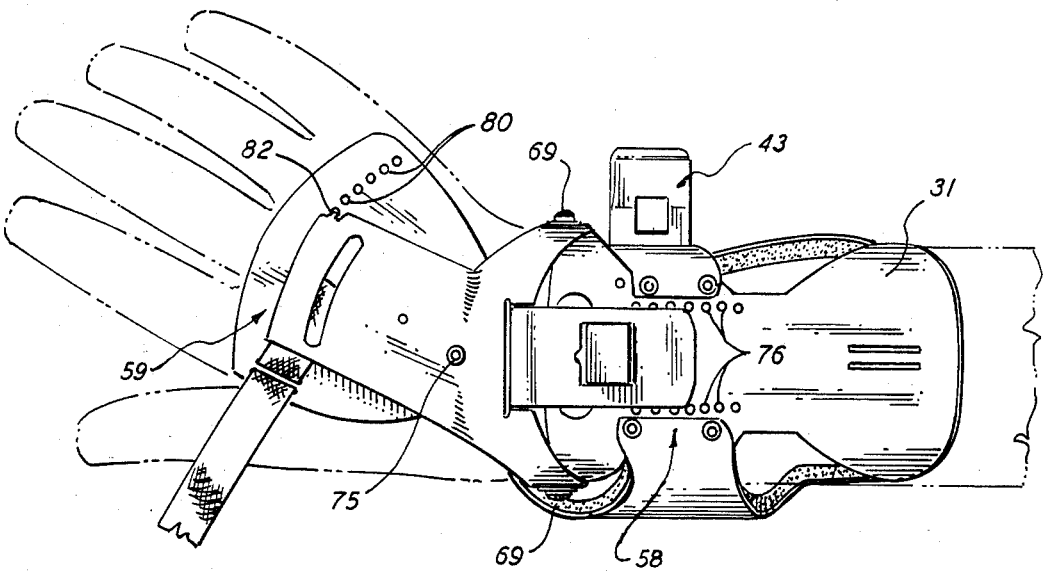
FIGS. 6 and 7 are each a top view of the present glove showing the hand engaging unit placed in two different positions.

Two parallel rows of equally spaced holes 76—76 are formed in the shell of the upper jaw member (FIG. 6). The holes are arranged to receive therein a pair of spaced apart teeth 77—77 that depend from the side margins of the locking member 61. By placing the teeth in a selected pair of holes, the angular positioning of the arm unit in regard to the connector can be set at a desired position to locate the hand of the bowler in the primary plane.

Figure 1:
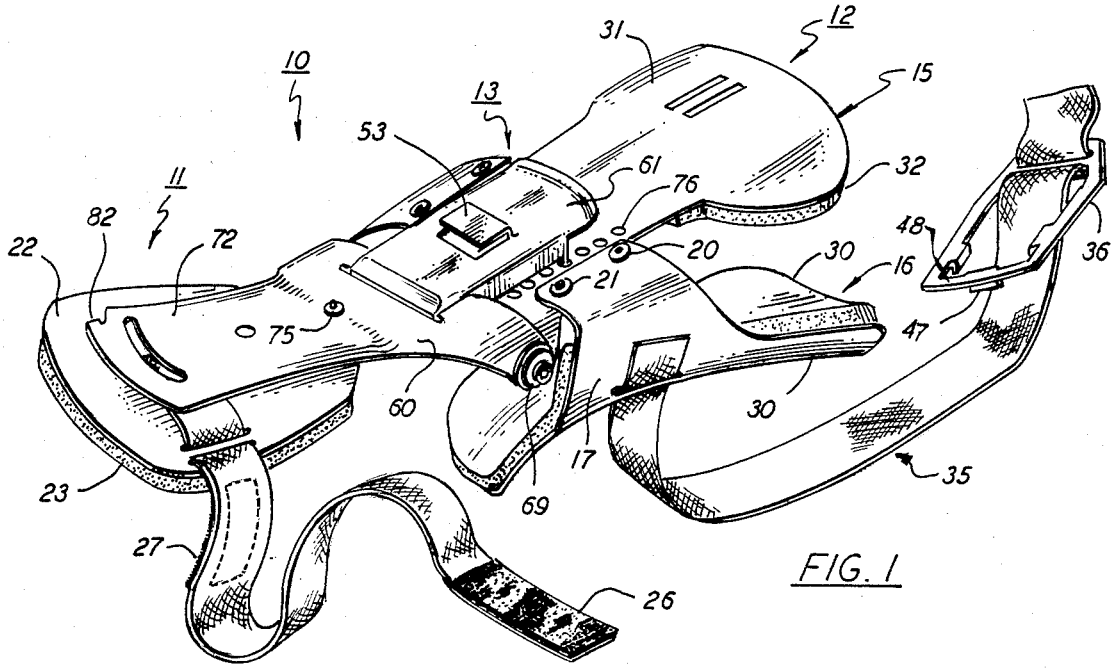
FIG. 1 is a perspective view of a bowling glove embodying the present invention for supporting the hand and arm of a bowler.
Figure 2:
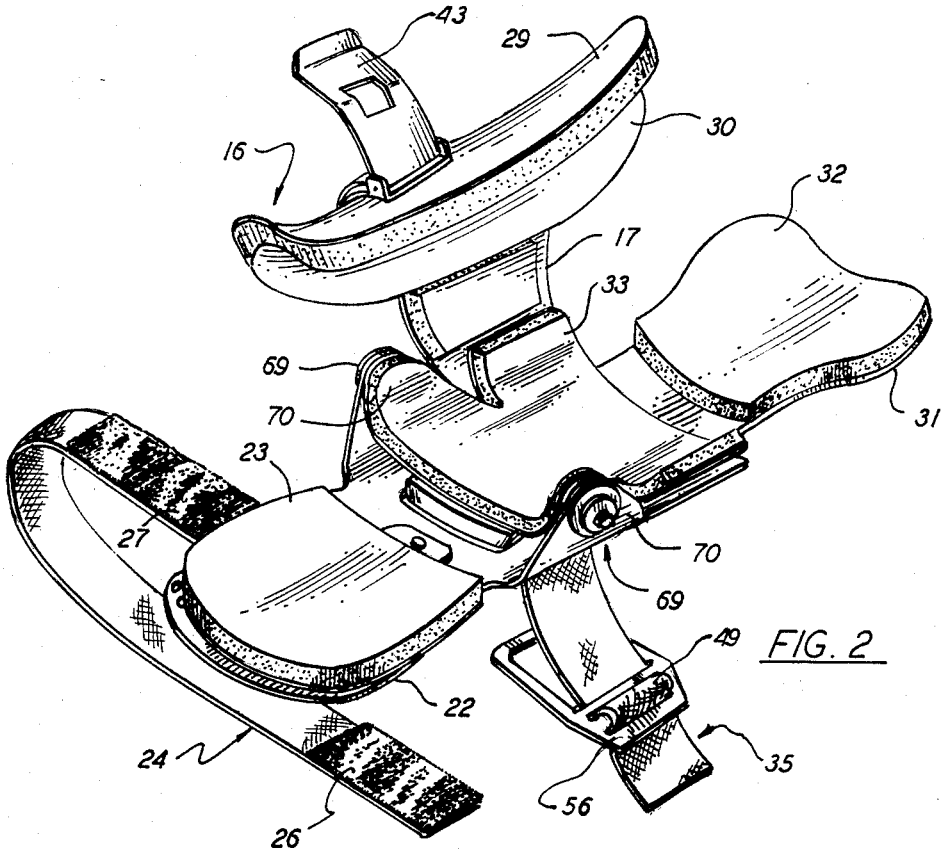
FIG. 2 is a further perspective view of the bowling glove shown in FIG. 1 further illustrating the underside of the glove.

As previously noted, the connector is arranged to pass over the back of the wrist with the front or nose section 72 thereof being positioned over the back surface of hand unit plate 22 (FIG. 2). The nose section of the connector frame is joined to the plate by means of a single vertical pivot pin 75 whereby the plate is able to swing about the pin in a secondary plane of rotation that is generally perpendicular to the above-noted primary plane of rotation. The secondary motion permits the hand to also be moved in a right-left direction.

As illustrated in FIG. 3, a linear series of holes 80—80 are formed in the plate of the hand unit that are adapted to receive therein a downwardly turned cog 82 that depends from the nose section 72 of the connector frame. There is sufficient flexibility in the pivot joint so that the cog can be easily repositioned in the holes thus allowing the hand unit to be selectively located at a desired position within the secondary plane of rotation.

As should now be evident, the locator can be releasably secured in the primary plane by the first locking unit 58 that includes the lever arm mechanism 61 and in the secondary plane of rotation by a second locking unit 59 that includes the cog mechanism found in the nose section 72 of the connector. By being able to adjust the positioner in two perpendicular planes, an infinite number of different hand positions can be obtained to accommodate all types of shots and lane conditions.

Both the strap 24 and the band 35 are fabricated from a flexible nylon fabric. As illustrated in the drawings, band 35 is wrapped about the first locking unit 58 while the strap 24 is similarly wrapped about the second locking unit to releasably maintain the units in the selected positions. Sufficient flexibility, however, is provided so that the position of both the hand unit and the arm unit can be altered without undoing either the strap or the band. However, when the strap and the band are tensioned during the delivery and release of a ball, an added locking pressure is placed on both locking units as well as the arm and hand units. Accordingly, the present positioner actually becomes more secure on the arm of the bowler during delivery than at other times thus insuring that the device will not slip or become misaligned when in use.

The up-down adjustment of the positioner in the primary plane of rotation allows the bowler to impart a desired amount of finger lift to the ball at the time of release. More lift imparts more rotation to the ball resulting in the ball hooking and thus increasing its striking power. Less lift provides for a straighter ball trajectory and possibly greater accuracy for some bowlers.

The left-right adjustment in the secondary plane of rotation furnished by the positioner causes the ball to either roll end over end or to spin as it moves down the lane. For a right-handed bowler, the position that places the hand to the extreme right in relation to the arm will cause the ball to attain maximum spin at release. Maximum roll is attained by moving the hand unit to the extreme left position. As should now be evident, with the two planes of adjustment afforded by the present positioner, a wide range of different shots can be achieved by the average bowler which will help improve his or her game by enhancing his scoring potential.

While this invention has been described with specific reference to the above-noted method, it should be clear to one skilled in the art that the invention is not limited by this disclosure.

I claim:

1. A release positioner for both supporting and positioning the hand of a bowler during the delivery and release of a bowling ball that includes a pair of hinged jaw members for encircling the bowler's arm adjacent the wrist, and means for tightening the jaw members against the bowler's arm, a hand unit having means for securing the said unit to the bowler's hand, a rigid connector passing over the back of the bowler's wrist for joining the arm unit and the hand unit, a pivot means acting between the arm unit and the connector for angularly positioning the arm unit within a primary plane that is substantially perpendicular to the plane described by the back of the bowler's hand, and locking means for releasably securing the jaw members of the arm unit at a desired position within said primary plane.

2. The positioner of claim 1 wherein the jaw members are elongated rigid elements that extend laterally along the arm to a length that is substantially equal to between one-third and one-half the arm's length between the wrist and elbow and which further includes soft pliable pads located on the interior surfaces of each jaw member for distributing the forces exerted by the jaws evenly over the enclosed arm area.

3. The apparatus of claim 1 wherein said locking means is a lever arm mounted for movement in said connector having at least one tooth that is receivable within a selected one of a series of spaced apart holes formed in one of said jaw members.

4. The apparatus of claim 3 wherein said means for securing the arm unit is a flexible band anchored at both ends in one of the jaw members that is capable of being wrapped about the jaw members and a releasable overcentered latch means for tensioning the band against said jaw members.

5. The apparatus of claim 4 wherein said lever arm includes a loop means for containing the band whereby the band applies an increased holding force against the lever and when the band is tensioned during delivery and release.

6. The apparatus of claim 1 that further includes a second pivot means acting between the connector and said hand unit for angularly positioning the hand unit in a secondary plane that is substantially perpendicular to said primary plane and a second locking means associated with the connecting means for releasably securing the hand unit at a desired position within said secondary plane.

7. The apparatus of claim 6 wherein said means for securing the hand unit to the bowler's hand is a flexible strap that is wrapped about the hand and said unit.

8. A release positioner for both supporting and positioning the hand of a bowler during the delivery and release of a bowling ball that includes an arm unit having a pair of hinged jaw members for encircling the arm of the bowler adjacent the wrist and securing the said unit to the arm, a hand unit having a plate covering the back of the bowler's hand and means for securing the plate to the hand, a connector passing over the back of the bowler's wrist for joining the plate to one of the said jaw members, a first pivot means for rotatably attaching the connector to said one jaw member for angularly positioning the arm unit in a primary plane, a second pivot means for rotatably attaching the connector to said plate for angularly positioning the plate in a secondary plane, clamping means for releasably securing the jaw members to the arm of a bowler, and locking means for releasably securing the hand and arm units in a selected position.

9. The positioner of claim 8 wherein said locking means includes a first lock for adjustably securing the arm unit at a desired position in said primary plane and a second lock for adjustably securing the hand unit in a desired position in said secondary plane.

10. The apparatus of claim 9 wherein the arm unit is positionable in a plane that is perpendicular to the plane described by the back of the bowler's hand and said secondary plane is perpendicular to said primary plane.

11. The apparatus of claim 9 wherein said first locking means includes a lever means rotatably mounted in the connector having a tooth that is receivable in one of a series of spaced apart holes formed in one of the jaw members.

12. The apparatus of claim 11 wherein said lever means further includes a loop means for slidably retaining the band whereby further tensioning of the band during delivery and release of the ball will hold the arm in a locking position.

13. The apparatus of claim 9 wherein said locking means is a tab depending downwardly from the connector that is receivably in one of a series of holes formed in the plate of the hand unit.

14. The apparatus of claim 13 that includes a strap for securing the hand unit to the hand of the bowler which is attached at both ends to the plate so that the strap can be wrapped about the connector adjacent to the tab to hold said tab in a selected one of the receiving holes formed in the plate.

15. The positioner of claim 8 wherein the jaw members and the hand plate each includes a soft resilient pad mounted upon the back surface thereof.

16. The apparatus of claim 15 having a flexible band secured at both ends to one of the jaw members that is capable of being wrapped about the jaw members and a latch means for tensioning the band about the members.

17. The apparatus of claim 8 wherein the one of the jaw members of the arm unit includes a plastic outer shell and a hinge connected to the other jaw member, said shell and hinge being formed from a single piece of plastic.

* * * * *